United States Patent [19]

Green

[11] 4,245,810

[45] Jan. 20, 1981

[54] APPARATUS FOR CONSTRUCTING CONCRETE CANTILEVERED DECKING AROUND SWIMMING POOLS

[76] Inventor: Melvin P. Green, 694 W. Worthington Rd., Imperial, Calif. 92251

[21] Appl. No.: 2,849

[22] Filed: Jan. 12, 1979

[51] Int. Cl.[3] ..... B28B 1/14

[52] U.S. Cl. ..... 249/19; 249/90; 249/96

[58] Field of Search ..... 249/15, 19, 90, 96; 264/34

[56] References Cited

U.S. PATENT DOCUMENTS

| | | | |
|---|---|---|---|
| 2,873,505 | 2/1959 | Sheldon | 264/34 |
| 3,128,524 | 4/1964 | Kay | 249/19 |
| 4,125,980 | 11/1978 | Miroldi | 249/19 |
| 4,136,850 | 1/1979 | Grosch | 249/19 |

*Primary Examiner*—John Parrish
*Attorney, Agent, or Firm*—Brown & Martin

[57] ABSTRACT

Disclosed is reusable form for constructing concrete cantilevered decking around a swimming pool of any shape. The form includes an anchoring member, a plurality of adjustable brackets connected to the anchoring member, and a pair of long flexible members lying between the anchoring member and the brackets. One of the flexible members has a width substantially equal to the desired overhang of the cantilevered decking while the second flexible member extends in height above the first flexible member to the desired thickness of the cantilevered decking. In operation, the form is rigidly connected via the anchoring member to the top portion of the walls of the pool. The adjustable brackets provide a means for moving the second flexible member to the desired thickness and grade of the overhang. And after the decking has hardened, the form is removed for reuse on other pools.

7 Claims, 5 Drawing Figures

FIG. 1
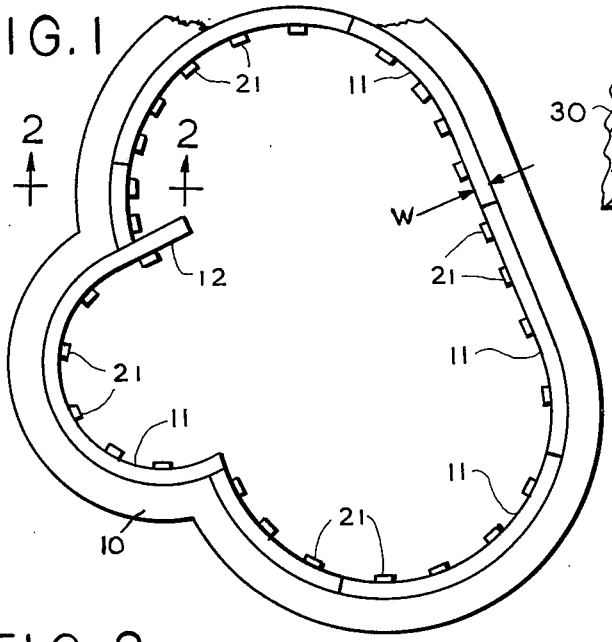
FIG. 2
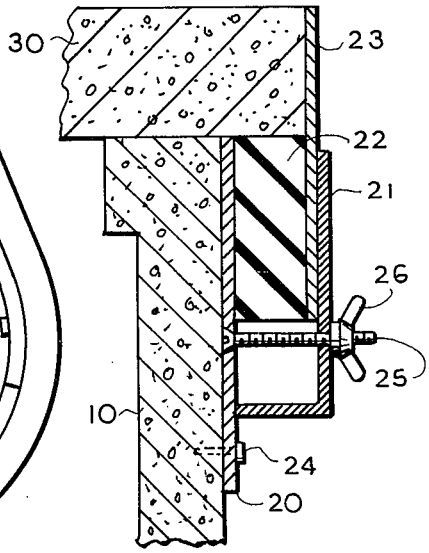
FIG. 3
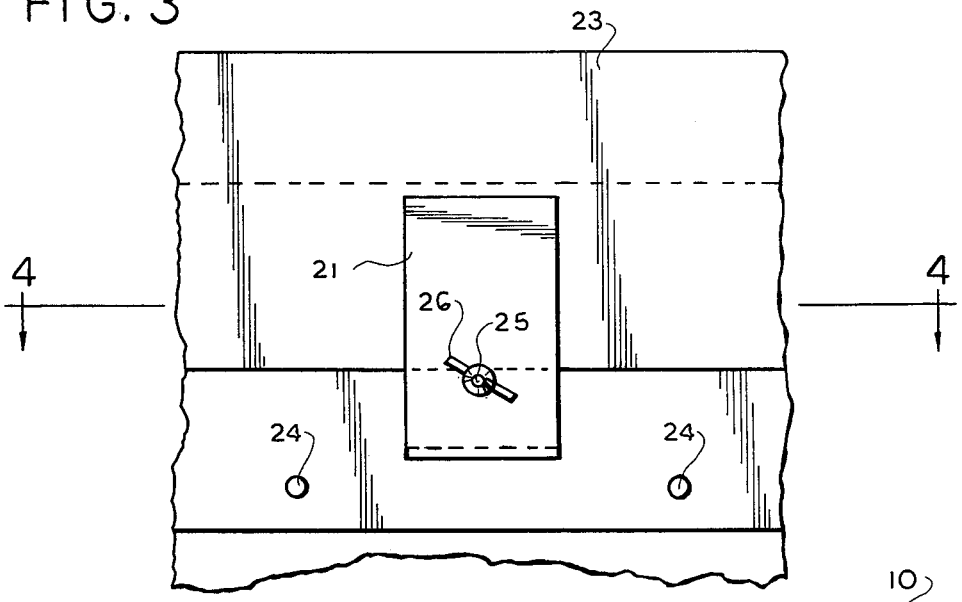
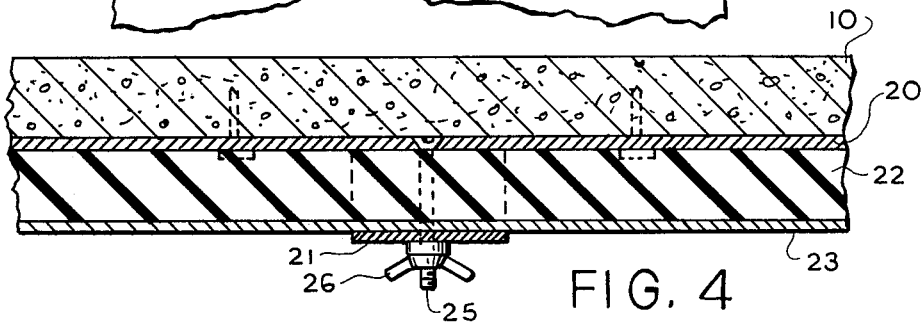
FIG. 4

APPARATUS FOR CONSTRUCTING CONCRETE CANTILEVERED DECKING AROUND SWIMMING POOLS

BACKGROUND OF THE INVENTION

This invention relates to apparatus and methods for constructing swimming pools, and more particularly to apparatus and methods for constructing cantilevered concrete decking around a swimming pool. As is well known, swimming pools have a virtually unlimited variety of shapes and sizes. This is because pool shapes are customized for the buyer. As a result, one of the items which significantly adds to the cost of a pool are the forms that are required to build decking around the pool. In the prior art, these forms were also custom made in accordance with the shape of the pool. Typically, the forms were made of wood. The wood was cut and nailed in place as a single integrated form extending around the inside of the pool. Then, after the decking was poured, the form was simply dismantled and thrown away as scrap material. This resulted in substantial waste which added to the cost of the pool.

Therefore, it is one object of the invention to provide a standard reusable form for constructing cantilevered decking on pools of any shape.

Another object of the invention, is to provide an improved method for constructing cantilevered decking around swimming pools of any shape.

BRIEF SUMMARY OF THE INVENTION

These and other objects are accomplished in accordance with the invention by a flexible reusable form that attaches to the top portion of the walls of the pool. Since the form is flexible, it can be bent to assume the shape of any pool. Then after the decking is poured, the form can be removed for use on other pools.

In one preferred embodiment, the form includes an anchoring member, a plurality of adjustable brackets connected to the anchoring member, and a pair of long flexible members lying between the anchoring member and the brackets. One of the flexible members has a width of substantially equal to the desired overhang of the cantilevered decking; while the second flexible member has a height which extends substantially above the first flexible member to the desired thickness of the decking.

In operation, a plurality of these forms are connected in edge-to-edge fashion around the top portion of the walls of the pool. These connections are made by means of the anchoring member. Also, the height of the second flexible member can be adjusted to the desired thickness and grade of the cantilevered decking by means of the adjustable brackets. The cantilevered decking is then formed in the space bounded by the pair of flexible members. And after the decking has hardened, the forms can be removed for reuse on other pools.

BRIEF DESCRIPTION OF THE DRAWINGS

The preferred embodiments of the invention will best be understood by reference to the following Detailed Description and concurrent reference to the accompanying drawings wherein:

FIG. 1 is a top view of a swimming pool having a plurality of forms that are constructed according to the invention attached thereto.

FIG. 2 is a cross-sectional view of the forms of FIG. 1.

FIG. 3 is a front view of the forms of FIG. 1.

FIG. 4 is a top view of the forms of FIG. 1.

DETAILED DESCRIPTION

Figure 5:
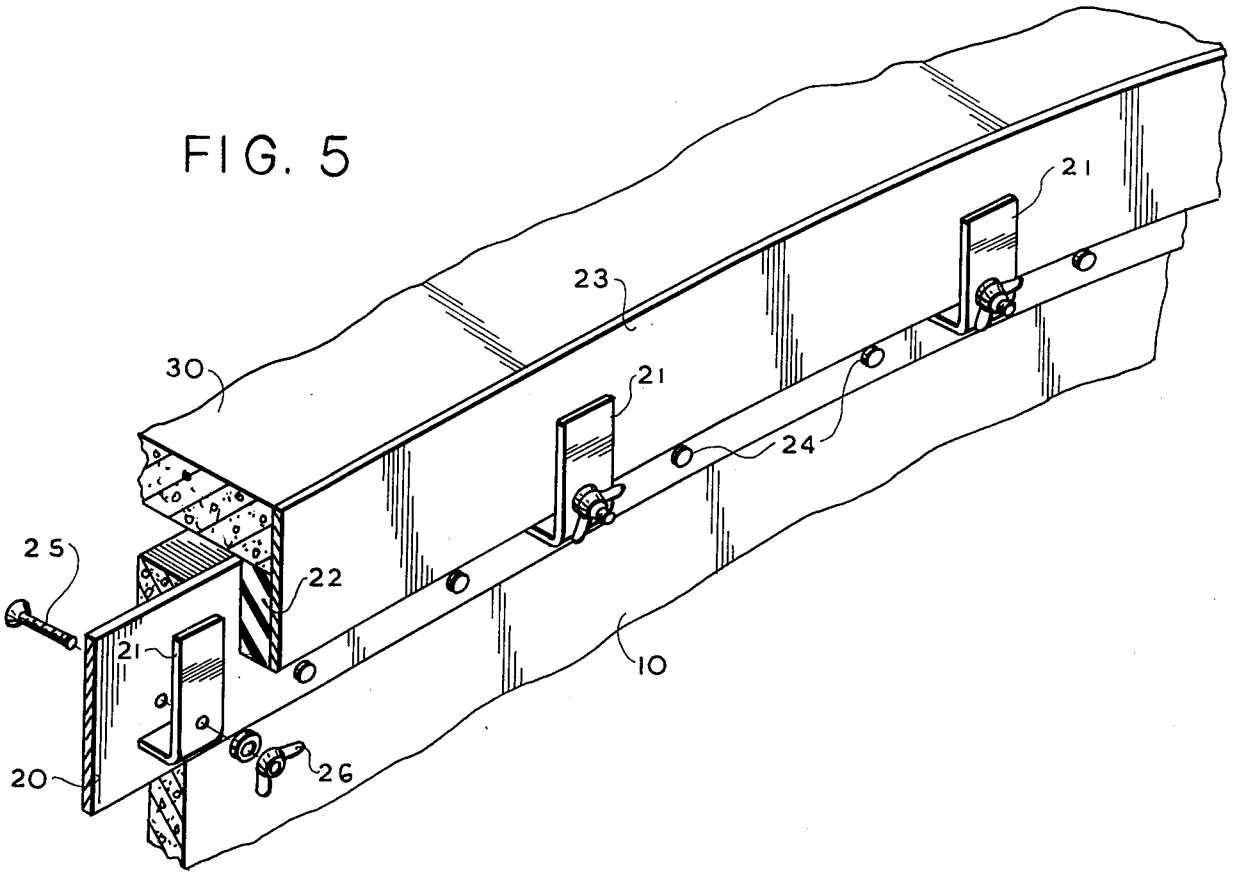
FIG. 5 is a pictorial view of the forms of FIG. 1.

Referring now to FIG. 1, there is illustrated a top view of a swimming pool 10 having a plurality of cantilevered decking forms 11 that are constructed according to the invention attached thereto. Each of the forms 11 has a width W, that is equal to the desired overhang of the cantilevered decking. Also, each form has a length which is as many times larger than this width. Suitably, the width and length of the forms 11 are three inches and ten feet respectively.

In operation, the forms 11 are attached to the perimeter of the pool 10 in an edge-to-edge fashion as illustrated. Preferably, this attachment is achieved by hammering concrete nails through the forms into the pool walls. Any excess length of the forms is simply extended into the interior portion of the pool as illustrated in region 12.

Additional details of the forms 11 and the manner in which they are attached to the pool 10 are illustrated in the cross-sectional view of FIG. 2. As therein illustrated, each form includes an anchoring member 20 for making the connection to the pool walls 10, a plurality of adjustable brackets 21 connected to the anchoring means 20, and a pair of long flexible members 22 and 23 lying between the anchoring member 20 and the brackets 21.

Member 22 provides substantially all of the desired width W to the form. In comparison, member 23 has a relatively narrow width but has a height that is substantially greater than that of member 22. It extends above member 22 to the desired thickness of the cantilevered decking.

In one preferred embodiment, member 22 consists essentially of rubber, and member 23 consists essentially of a light flexible metal. Suitably, member 23 is made of aluminum. It is to be understood however, that these materials can be replaced by other materials having similar flexibility and strength characteristics.

In the illustrated preferred embodiment of FIG. 2, the anchoring member 20 is similar in construction to member 20. That is, it is long, and relatively narrow, and also consists essentially of a metal such as aluminum. In that embodiment, member 20 is rigidly attached to the walls of pool 10 by a plurality of concrete nails 24.

Also in the preferred embodiment, each of the brackets 21 are connected to the anchoring member 20 by a bolt 25 and a wing-nut 26. This is illustrated in FIG. 2. There, the head of bolt 25 is recessed into member 20 to allow the latter to be placed flush against the walls of pool 10.

Referring now to FIG. 3, there is illustrated a front view of a portion of form 11 as it is attached to pool 10. A suitable sequence for attaching the form to the pool is as follows. First, form 11 is assembled by interconnecting components 20, 21, 22, 23, via bolts 25 and nuts 26. The form is then rigidly connected to the top portion of the walls of pool 10 by the concrete nails 24. During this step, the forms are connected such that the top surface of member 22 lies substantially flush with the top surface of the pool walls 10.

Subsequently, the member 23 is adjusted to the desired thickness and grade of the cantilevered decking.

Then it is held securely in place by tightening the wing-nuts 26. The steps are then repeated until the forms lie in edge-to-edge fashion around the entire pool. After this, the cantilevered decking 30 is poured in the space bounded by the securely held members 22 and 23. Then, after the decking hardens, the forms 11 are removed for reuse on other pools.

A detailed top view of form 11 prior to the pouring of the decking 30, and a pictorial view of form 11 subsequent to the pouring of the decking 30 is illustrated in FIGS. 4 and 5 respectively. In these Figures, like reference numerals indicate those portions of the form that have been described above. These views, together with the above description, clearly illustrate the substantial utility and ease with which the invention may be practiced.

A preferred embodiment of a flexible reusable form for constructing cantilevered decking, as well as suitable steps for using these forms to construct such decking has now been described in detail. In addition, many changes and modifications can be made to these details without departing from the nature and spirit of the invention. Therefore, it is to be understood that the invention is not to be limited to said details, but is defined by the appended claims.

I claim:

1. A flexible reusable form for constructing cantilevered decking around a swimming pool of any shape comprised of:

anchoring means for making rigid connections to the top portion of the walls of said pool;

a plurality of adjustable brackets connected to said anchoring means;

a first long flexible member aligned between said anchoring means and said brackets, and having a width substantially equal to the desired overhang of said cantilevered decking;

a second long flexible member aligned between said first flexible member and said bracket and extending in height above said first flexible member; and said bracket being connectable to said anchoring means below the nominal position of said first long flexible member.

2. A form according to claim 1 wherein said bracket comprises a substantially L-shaped plate.

3. A bracket according to claim 2 wherein said bracket is connectable to said anchoring means by a bolt received on said anchoring means and a nut threadable against said L-shaped bracket.

4. A form according to claim 1 wherein said first long flexible member consists essentially of rubber.

5. A form according to claim 1 wherein said second long flexible member consists essentially of metal.

6. A form according to claim 1 wherein said anchoring means consists of a third long flexible member and means for attaching said brackets thereto.

7. A form according to claim 2 wherein said third long flexible member consists essentially of metal.

* * * * *